United States Patent [19]

Wilson, Jr.

[11] Patent Number: 4,599,488

[45] Date of Patent: Jul. 8, 1986

[54] UNIVERSAL NAIL-ON INSULATOR

[75] Inventor: Robert M. Wilson, Jr., Battle Creek, Mich.

[73] Assignee: Dare Products, Inc., Battle Creek, Mich.

[21] Appl. No.: 775,339

[22] Filed: Sep. 12, 1985

[51] Int. Cl.[4] ..... H01B 17/16; H01B 17/24

[52] U.S. Cl. ..... 174/158 F

[58] Field of Search ..... 174/158 R, 158 F, 161 F, 174/163 F, 164, 166 R, 174, 175; D13/17, 18

[56] References Cited

U.S. PATENT DOCUMENTS 4,028,489 6/1977 Berg, Jr. et al. ..... 174/166 R 4,263,477 4/1981 Wilson, Sr. ..... 174/158 F

FOREIGN PATENT DOCUMENTS 2937495 3/1980 Fed. Rep. of Germany ... 174/166 R

*Primary Examiner*—Laramie E. Askin

*Attorney, Agent, or Firm*—Irvin L. Groh

[57] ABSTRACT

A molded one-piece electric fence post insulator which can be installed on a flat or round wood post with a single nail. A forward planar post engaging panel has a vertically extending wing at each lateral side. The wings extend forwardly of the panel plane from vertical hinge lines so that as the insulator is nailed against a round post, the wings engage the post to firmly hold the insulator against twisting, and as the insulator is nailed against a flat post, the wings fold rearwardly along the hinge lines presenting planar contact of the insulator with the post.

10 Claims, 6 Drawing Figures

UNIVERSAL NAIL-ON INSULATOR

This invention relates to electric fence post insulators, and, more particularly, to such insulators for nailing to wooden posts.

A variety of wire carrying insulators have been designed for electric fence installation on wood posts. Most have been designed for installation on round posts, having conforming curved or angled planar surfaces adapted to hold the insulator vertically aligned with the post. These have been implemented with forwardly directed projections in the form of knife edge cleats which dig into the periphery of the round post to prevent twisting. When an attempt is made to install this type of insulator on a flat post, the insulator either breaks or is not held firmly enough to avoid twisting. The problem of installing an insulator on a flat post has been solved by providing a planar mounting surface which is driven against the post by the nail impact. Unfortunately, the flat, planar mounting surface provides substantially only a straight line contact when an attempt is made to nail it to a round post. Thus the insulator is subject to twisting.

It is a primary object of this invention to provide an electric fence post insulator of a universal type which can be installed on flat or round posts.

It is another object of this invention to provide a universal electric fence post insulator which can be installed with a single nail and still not be subject to twisting.

It is a further object of this invention to provide a universal electric fence post insulator which can be molded as a single piece and which can be reused after being installed on either a round or flat post.

The foregoing objects of this invention have been accomplished in a nail-on electric fence post insulator which has been molded as a single piece body having a forward planar mounting panel for attachment to the post in a generally vertically extending plane. The body has an intermediate angled, nail holding and guiding surface and a rearwardly extending wire holding means. Aligned aperture means in the form of holes through the intermediate angled surface and the mounting panel form a passageway to receive a mounting nail which extends downwardly at an acute angle to the horizontal from the intermediate surface through the mounting panel.

A pair of vertically extending wings, one at each lateral edge of the mounting panel, extend forwardly of the panel from vertical hinge lines. As the insulator is affixed to the wood post by hammering a nail which extends through the insulator holes, the wings engage the periphery of a round post to firmly hold the insulator thereagainst without twisting. As the wings engage a flat post, they will fold rearwardly along the vertical hinge lines, allowing the planar mounting surface to have full contact with the post which firmly holds the insulator without twisting.

When the insulator is mounted on a flat post, the wings fold back presenting surfaces in a common plane with the mounting panel.

More particularly, the insulator body has a pair of substantially parallel legs which extend between the forward post mounting panel and a rearward wire holding panel. The intermediate nail holding surface has a lower portion which is joined to the legs and an upper portion which extends above the vertical height of both the post mounting panel and the wire holding panel and is angled upwardly toward the post mounting panel. A rounded cover surface extends transversely between the legs forwardly from the angled upper surface to the mounting panel. The rounded cover surface is in close proximity to the passageway created by the nail apertures so that it can act as an upper nail guiding surface when the nail is inserted into the insulator apertures.

The insulator is adapted to hold a wide variety of electric wires such as a single uninsulated wire or a dual barbed wire. This is accomplished by a pair of lugs which extend rearwardly from the wire holding panel in line with the forwardly extending legs. One of the lugs has an upwardly opening slot and the other of the lugs has a downwardly opening slot. These lugs accommodate a wire extending perpendicularly through the slots.

The wings are necessarily formed with a stiff hinge connection to the forward post mounting panel so that as the insulator is attached to a rounded post by hammer impact on the nail, the wings bite into the post periphery for resilient retention against twisting. However, when the insulator is attached to a flat post, the wings yield to present planar contact of the mounting panel with the post. This stiff hinge is formed by a V-recess into the rearward side of the mounting panel along the vertical hinge line. This allows the wings to fold back, the forward wing surfaces and the forward face of the mounting panel presenting an integral planar contact surface with the flat post surface. This hinge structure retains its stiff resilience, the wings springing back to their original forward position, if the insulator is removed from a flat post so that it can be reused.

The insulator must have a stiff structural configuration to withstand the force transmitted by the hammer-nail impact. The lower structural support portion of the intermediate surface which extends in a vertical place and the rounded cover between the intermediate surface and the forward mounting panel provides this stiffness. Additionally, a transversely extending horizontal slat joins the legs between the intermediate surface and the rearward wire holding panel.

Direction of the impact force through the insulator and retention of the nail against the upper nail holding surface of the intermediate panel is facilitated by the use of a boss adjacent the nail hole. This boss serves as a bearing surface for the head of the nail. Preferably, the boss is defined by an outwardly extending rounded rib on each side of the hole.

The objects of this invention are accomplished by the embodiment disclosed in the following description and illustrated in the drawing in which.

Universal insulator 10 is molded as an integral one-piece body from a weather-proof, electrically insulating resilient plastic having high impact strength such as polyethylene. The unit is specifically designed to be mounted to a round wood post 12 or flat wooden post 14 by the use of a single nail 16.

Figure 1:
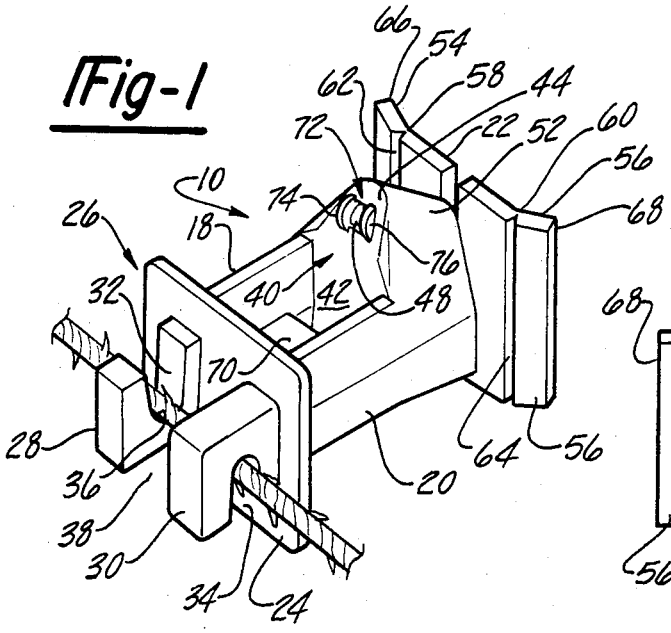
FIG. 1 is a perspective view of the insulator from the rearward wire holding panel to the forward post mounting panel showing the details of the vertically extending wings of this invention which permit mounting on round or flat wood posts.
Figure 2:
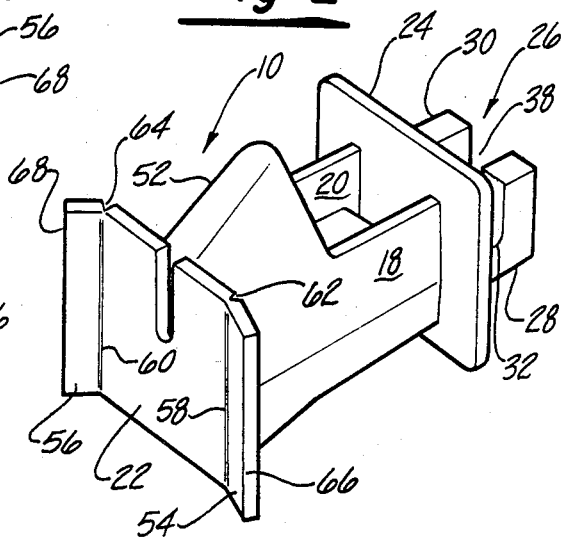
FIG. 2 is a perspective view similar to FIG. 1 showing the insulator of this invention from the forward mounting panel side.
Figure 3:
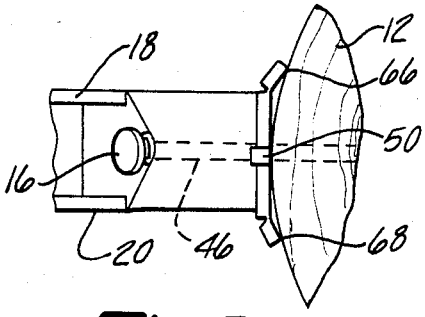
FIG. 3 is a partial plan view showing the insulator of this invention installed on a round post.
Figure 4:
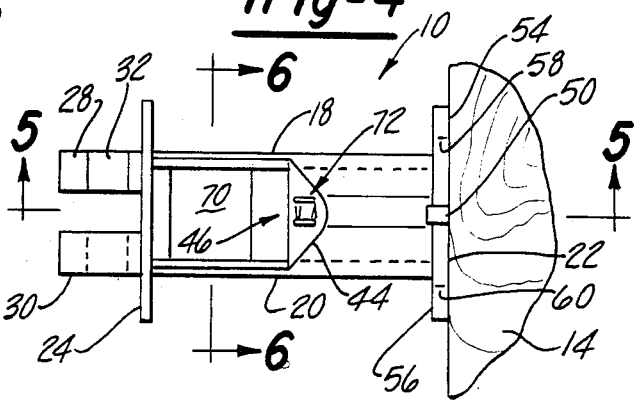
FIG. 4 is a plan view similar to FIG. 3 showing the insulator of this invention installed on a flat post.
Figure 5:
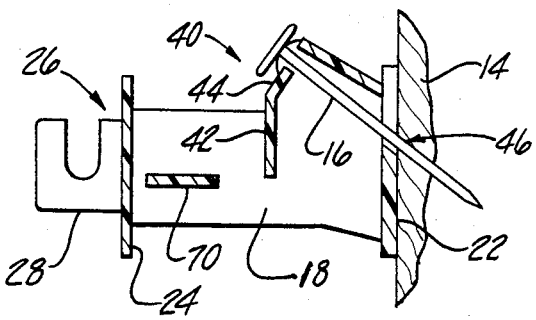
FIG. 5 is a side sectional view taken along line 5—5 of FIG. 4 showing the insulator of this invention held by a single nail installed on a flat wood post.
Figure 6:
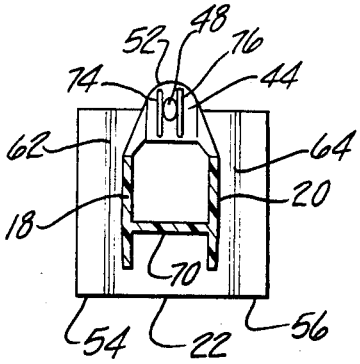
FIG. 6 is a sectional view taken along line 6—6 of FIG. 4 showing the parallel legs and rearward bracing slat.

The body of the insulator has a pair of side plates or legs 18 and 20 extending between a forward planar mounting panel 22 and a rearward wire holding panel 24. As can be seen in FIGS. 2 and 3, the mounting panel 22 is installed against a round post 12 or a square post 14 in a generally vertically extending plane.

The wire holding means 26 includes the wire holding panel 24 and a pair of parallel lugs 28 and 30 extending rearwardly therefrom in line with legs 18 and 20. One of the lugs 28 has an upwardly extending slot 32, and the other of the lugs 30 has a downwardly extending slot 34 which accommodates the wire 36, shown as a dual barbed wire, extending therethrough. The spacing 38 between lugs 28 and 30 accommodates various sizes of single or double wires which can be slipped between the two lugs when they are held in a horizontal position. The wire is captured when the insulator is rotated 90 degrees for mounting on a vertical post.

An intermediate surface 40 has a lower structural support portion 42 extending in a substantially vertical plane and joined to the two legs 18 and 20. The intermediate surface 40 has an upper nail holding portion 44 which extends above the vertical extent of the post mounting panel 22 and the wire holding panel 24. This upper portion 44 angles upwardly toward post mounting panel 22. Aligned aperture means 46 in the form of a hole 48 through the intermediate surface 40 and hole 50 through post mounting panel 22 provides a passageway extending downwardly at an acute angle to the horizontal to receive the nail 16 as it is inserted from the intermediate surface through the mounting panel.

A rounded cover surface 52 extends upwardly from and is a part of the two legs 18 and 20 and is sloped downwardly from the upper portion 44 of the intermediate surface 40 to the forwardly located post mounting panel 22, the portion of cover surface 52 at the top being substantially circular and in close proximity to the aperture means or passagway 46 to act as a nail guiding surface when the nail 16 is inserted into hole 48.

A pair of parallel vertically extending wings 54 and 56, one at each lateral side of the mounting panel 22, extend forwardly of the panel from vertical hinge lines 58 and 60. Stiff hinge connections are formed between the wings 54 and 56 and the mounting panel 22 by V-recesses 62 and 64 formed into the rearward side of the panel 22 along the vertical hinge lines 58 and 60. The corners 66 and 68 at the inward free sides of wings 54 and 56 act as cleats when the insulator is installed on a round post. That is, as the insulator 10 is attached to round post 12 by hammer impact on the nail 16, the corners 66 and 68 of wings 54 and 56 bite into the post periphery for resilient retention of the insulator against twisting. However, when the insulator 10 is attached to a flat post 14, the wings 54 and 56 yield along vertical hinge line 58 and 60, folding rearwardly, to present a planar contact of the mounting panel 22 with the post 14. With a completely snug fit of the panel 22 against flat post 14, the forward wing surfaces and the forward face of the mounting panel present an integral planar contact surface with the flat post surface. The stiff resilience of the hinge is retained and the wings will spring back to their original position if the insulator is removed so that it can be reused.

The overall insulator must have a corresponding stiff structural configuration to withstand the force and transmit it during the hammer impact of installation. The lower structural support portion 42 of the intermediate surface 40 extends in a vertical plane between the two legs 18 and 20, and the rounded cover 52 which extends upwardly from these legs to form an arch, provides this stiffness. Transversely extending horizontal slat 70 joining the legs between the intermediate surface 40 and the rearward nail holding panel 24 may be added to further enhance the structural integrity of the insulator.

The impact force created during installation is directed through the insulator, and the retention of the nail 16 against the upper nail holding surface 44 is facilitated by the use of a boss 72 adjacent nail hole 48. The boss serves as a bearing surface for the head of nail 16. Preferably, the boss is defined by outwardly extending rounded ribs 74 and 76 on each side of the hole 48.

The embodiments of the invention in which an exclusive property or privilege is claimed are defined as follows:

1. A nail-on electric fence insulator for installation on flat and round wood posts, said insulator being molded as a single piece body comprising, in combination: a forward mounting panel for attachment to a post in a generally vertically extending plane; an intermediate angled, nail holding and guiding surface; rearward extending wire holding means; aligned aperture means through said intermediate angled surface and said mounting panel forming a passageway to receive a nail extending downwardly at an acute angle to the horizontal from said intermediate surface through said mounting panel; a pair of vertically extending wings, one at each lateral edge of said mounting panel extending forwardly of said panel from vertical hinge lines; whereby as said insulator is affixed to a wood post by hammering a nail extending through said aperture means, said wings will engage the periphery of a round post to firmly hold said insulator thereagainst without twisting, and as said wings engage a flat post they will fold rearwardly along said vertical hinge lines presenting planar contact therewith.

2. The insulator of claim 1 wherein said planar contact of said insulator with said flat post includes the forward surface of said panel and the forward surfaces of said wings as they are folded back in a common plane with said panel.

3. The insulator of claim 1 wherein the aligned aperture means passes through said panel above the vertical mid point thereof.

4. The insulator of claim 1 wherein said wire holding means includes a pair of rearwardly extending parallel lugs, one of said lugs having an upwardly opening slot and the other of said lugs having a downwardly opening slot to accommodate a wire extending perpendicularly through said slots.

5. A nail-on electric fence insulator for installation on flat and round wood posts, said insulator being molded as a single piece body comprising, in combination: a pair of substantially parallel legs extending between a forward post mounting panel and a rearward wire holding panel; an intermediate surface having a lower structural support portion joined to said legs and an upper nail holding portion extending above the vertical extent of said post mounting panel and said wire holding panel and angled upwardly toward said post mounting panel; aligned aperture means through the upper portion of said intermediate angled surface and said mounting panel forming a passageway to receive a nail extending downwardly at an acute angle to the horizontal from the upper portion of said intermediate surface through said mounting panel; a pair of vertically extending wings, one at each lateral edge of said post mounting panel, extending forwardly of said panel from vertical hinge lines; whereby as said insulator is affixed to a wood post by hammering a nail extending through said aperture means, said wings will engage the periphery of a round post to firmly hold said insulator thereagainst without twisting and as said wings engage a flat post they will fold rearwardly along said vertical hinge lines presenting planar contact of said insulator with said post.

6. The insulator of claim 5 further comprising a rounded cover surface extending transversely between said legs and forwardly from said intermediate surface to said mounting panel in close proximity to said passageway acting as an upper nail guiding surface as said nail is inserted into said aperture means.

7. The insulator or claim 6 wherein the lower structural support portion of said intermediate surface extends between said legs in a substantially vertical plane and further including a transversely extending horizontal support slat joining said legs between said intermediate surface and said wire holding panel.

8. The insulator of claim 5 wherein said wire holding panel has a pair of parallel lugs extending rearwardly therefrom in line with said pair of legs, one of said lugs having an upwardly opening slot and the other of said lugs having a downwardly opening slot to accommodate a wire extending perpendicularly through said slots.

9. The insulator of claim 5 wherein the upper nail holding portion of said intermediate surface has a boss in proximity to said aperture means which serves as a bearing surface for the head of said nail.

10. The insulator of claim 9 wherein said boss is defined by a rounded rib extending outwardly on both sides of said aperture means.

* * * * *